United States Patent [19]

Stahlecker et al.

[11] 4,103,479

[45] Aug. 1, 1978

[54] TANGENTIAL BELT DRIVE MECHANISM FOR SPINNING ROTORS

[76] Inventors: Fritz Stahlecker, Josef-Neidhart-Str.18, 7341 Bad Uberkwgen; Hans Stahlecker, Haldenstrasse 20, 7334 Süssen, both of Fed. Rep. of Germany

[21] Appl. No.: 758,791

[22] Filed: Jan. 12, 1977

[30] Foreign Application Priority Data

Jan. 23, 1976 [DE] Fed. Rep. of Germany ..... 2602392

[51] Int. Cl.[2] ..... D01H 1/241

[52] U.S. Cl. ..... 57/105; 57/88; 74/226

[58] Field of Search ..... 57/58, 89, 78, 88, 104–105; 74/221, 226

[56] References Cited

U.S. PATENT DOCUMENTS

| | | | |
|---|---|---|---|
| 2,023,407 | 12/1935 | Cobb | 57/88 X |
| 2,718,747 | 9/1955 | Honig | 57/104 X |
| 3,016,680 | 1/1962 | Warnock | 57/88 |
| 3,036,421 | 5/1962 | Schroder | 57/88 |
| 3,352,095 | 11/1967 | Heumann | 57/105 |
| 3,364,764 | 1/1968 | Fiddes | 74/221 |
| 3,765,161 | 10/1973 | Kobler | 57/105 X |
| 3,868,815 | 3/1975 | Stahlecker | 57/105 X |

*Primary Examiner*—Richard C. Queisser
*Assistant Examiner*—Charles Gorenstein
*Attorney, Agent, or Firm*—Craig & Antonelli

[57] ABSTRACT

Apparatus for driving spinning rotors at a plurality of spinning units to an open-end spinning machine is provided which includes a tangential belt extending adjacent rotor shafts of the spinning units, as well as movable pressure rollers for selectively forcing the tangential belt against the respective rotor shafts to drive the same. In order to prevent sliding the tangential belt against the rotor shafts when in the non-driving position, guide rollers are disposed at the side of the tangential belt opposite the pressure rollers, which guide rollers are offset so that a common tangent to the guide rollers is spaced from the surface of a rotor shaft therebetween, whereby the guide rollers serve to hold the tangential belt out of driving contact when the pressure rollers are moved away from their driving positions.

19 Claims, 3 Drawing Figures

TANGENTIAL BELT DRIVE MECHANISM FOR SPINNING ROTORS

BACKGROUND AND SUMMARY OF THE INVENTION

This invention relates to a tangential belt drive mechanism for spinning rotors of spinning units of an open-end spinning machine, wherein a tangential belt is pressed, in the zone of each spinning unit, against a rotor shaft with a spring-loaded, movable pressure (contact) roll, which latter can be moved away from the rotor shaft in order to interrupt the drive.

In a conventional type of construction of U.S. Pat. No. 3,868,815 dated Mar. 4, 1975 (DOS[German Unexamined Laid-Open Application]21 41 276), wherein the rotor shafts of the spinning rotors are supported in V-slots formed by pairs of supporting disks, the pressure roll of the respective spinning unit is moved away from the rotor shaft in order to arrest a spinning rotor, while simultaneously a brake is applied to the rotor shaft. The tangential belt relieved of the pressure roll then drags over the rotor shaft arrested by means of the brake. Since the tangential belt in this case contacts the rotor shaft with a substantially lesser tension than in the operation condition, this type of arresting a spinning rotor can be permissible, insofar as this need not be done over a rather long period of time. However, if longer periods of a standstill are to be expected, there is the danger that increased wear occurs in such a case after a longer operating time.

In tangential belt drive mechanisms for spinning spindles, it has been known (German Patent 20 48 959) to lift the tangential belt upon a standstill of the device to such an extent that the connection of the spindle to the tangential belt is entirely interrupted. In this type of structure, in order to interrupt the drive operation, it is not the pressure roll which is relieved in order to interrupt the drive, but rather the tangential belt is moved away from the spindle with the aid of two additional lifting rollers. This type of construction requires, on the one hand, a considerable expenditure and, on the other hand, leads to an increased stress on the belt, since relatively great deflections of the tangential belt are effected for the arresting step, so that the belt can be lifted completely off the spindle.

The invention is based on the problem of fashioning a tangential belt drive mechanism of the type mentioned in the foregoing so that the tangential belt, during the arresting of a spinning rotor, is entirely free of the braked rotor shaft without subjecting the belt to additional stresses by such a disengagement from the rotor shaft. This problem is solved by providing that stationary guide rollers are arranged on the side of the tangential belt facing away from the pressure rollers, the periphery of these guide rollers, conducting the tangential belt, being offset with respect to the neighboring rotor shafts so that a common tangent laid from this peripheral zone of the guide rollers to the peripheral zone guiding the tangential belt on the same side and pertaining to the component following the neighboring rotor shafts passes by (extends past) the neighboring rotor shafts. By means of these stationary guide rollers, a belt path is fixed for the unstressed tangential belt which leads past the rotor shafts. The rotor shafts are driven if the tangential belt is especially brought into engagement with these shafts by means of the associated pressure rollers. It is possible, in this connection, to operate with minor offet positions, especially if the pressure rollers are arranged relatively closely adjacent the associated rotor shafts, so that the deflections between the operating condition and the braking condition are practically not varied appreciably for the tangential belt. This arrangement has the advantage that only a small structural expenditure is required, especially since no additional parts are required which have to be adjusted during the braking step.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
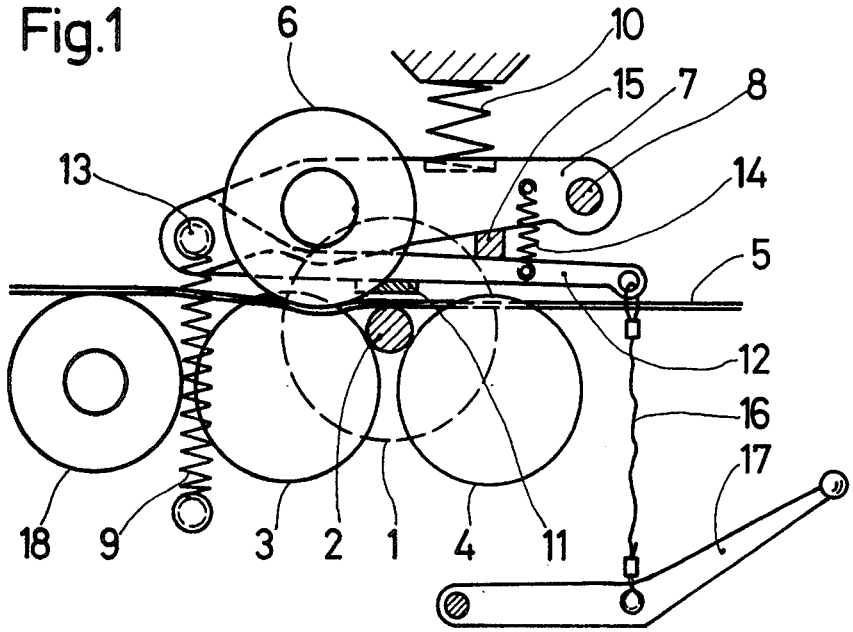
FIG. 1 is a schematic view which shows a tangential belt drive mechanism according to this invention in the zone of a spinning unit in the operating condition.

In FIG. 1, a spinning rotor 1 of a spinning unit is indicated in dashed lines, the rotor shaft 2 of which is supported in a V-slot formed by two supporting disk pairs 3 and 4. The rotor shaft 2 is driven by a tangential belt 5 which directly engages the shaft and serves for driving the spinning rotors 1 of several spinning units disposed in side-by-side relation (see also FIG. 3). The tangential belt 5 is urged, in the region of the rotor shaft 2, i.e., at a relatively minor distance from the rotor shaft, toward the latter by means of a pressure roller 6 so that a sufficient belt tension is obtained. The pressure roller 6 is supported with a swivel arm 7 with the swivel axle 8, this swivel arm being under the load of springs 9 and 10. Under practical conditions, only one of the springs 9 or 10 is sufficient in many instances. The arrangement is such that the pressure roller 6 is disposed, with respect to the tangential belt 5, on the other side from the supporting disk pairs 3 and 4 and from the rotor shaft 2, so that the rotor shaft 2 is pressed, by the tangential belt 5, into the V-slot formed by the supporting disk pairs 3 and 4 and is secured in its operating position.

In order to be able to arrest the rotor shaft 2, which latter is preferably disposed horizontally, a brake is provided consisting essentially of a brake lining 11 which can be associated with the rotor shaft 2 from above. This brake lining 11 is carried by a brake arm 12 mounted with a joint 13 to the free end of the swivel arm 7, extended past the pressure roller 6. The brake arm 12 lies underneath and somewhat in parallel to the swivel arm 7, so that the brake lining 11 and the pressure roller 6 are located in relatively close proximity to each other in the zone of the rotor shaft 2 and on the same side with reference to the tangential belt 5. In the operating position shown in FIG. 1, wherein the pressure roller 6 presses the tangential belt 5 to the rotor shaft 2, a tension spring 14 ensures that the brake lining 11 is lifted off the rotor shaft 2. The tension spring 14 is suspended in pins of the swivel arm 7 and of the brake arm 12. Between the brake arm 12 and the swivel arm 7, a buffer 15 of a synthetic resin is arranged. A drawstring 16 is hung into the free end of the brake arm 12, thus connecting the brake arm 12 with a brake lever 17.

On the same side of the tangential belt 5 as the rotor shaft 2 and the pairs of supporting disks 3 and 4, a fixedly arranged guide roller 18 is provided, i.e., on the side of the tangential belt 5 facing away from the pressure roller 6. The zone of the periphery of the guide roller 18 which is in contact with the tangential belt 5 is offset to a minor extent in the direction toward the pressure roller 6 with respect to the zone of the periphery of the rotor shaft 2 likewise contacted by the tangential belt. This means that the tangential belt 5 assumes a somewhat different level in the region of the guide roller 18 than in the region of the rotor shaft 2. The deflections of the tangential belt 5 are illustrated on an exaggerated scale in FIG. 1 to bring out the principle more clearly.

Figure 2:
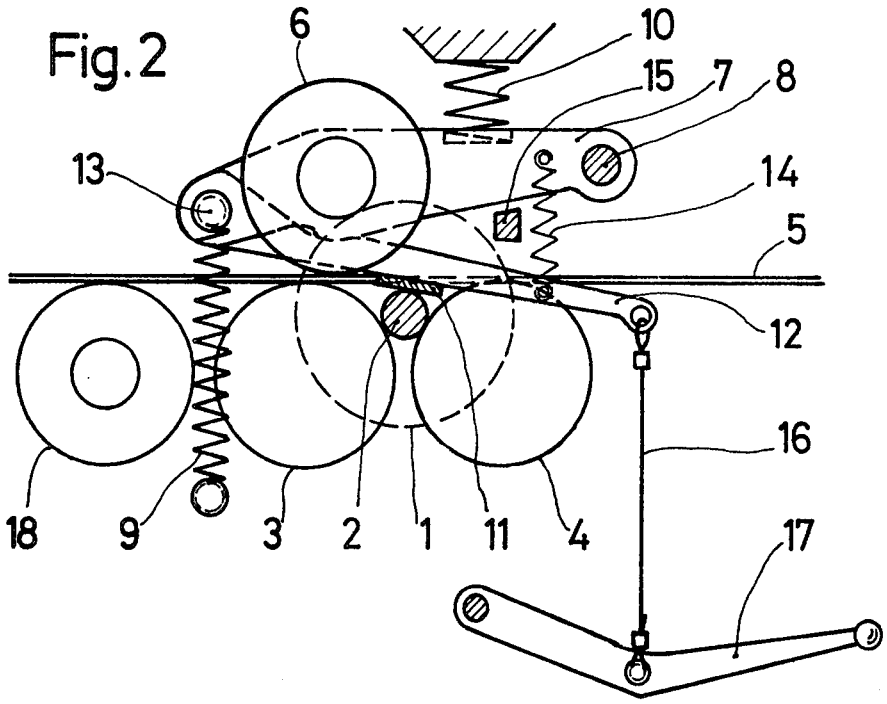
FIG. 2 shows the tangential belt drive mechanism of FIG. 1 with the spinning rotor being braked.

If the brake lever 17 (see FIG. 2) is pivoted downwardly and thus the drawstring 16 is tautened, the force of the spring 14 is first overcome so that the brake lining 11 contacts the rotor shaft 2. Upon a further movement of the brake lever 17, the end of the brake arm 12 is pulled further downwardly, this arm then being tilted about the rotor shaft 2 so that the joint 13 is lifted. This results in a lifting of the swivel arm 7 and a lifting off of the pressure roller 6 from the rotor shaft 2. This lifting off of the pressure roller 6 takes place against the action of the springs 9 and 10 which thereby determine the braking force to be expended, i.e., the force with which the brake lining 11 is pressed against the rotor shaft 2. This force corresponds to double the sum total of the forces of springs 9 and 10 minus the force of the tension springs 14. This arrangement ensures that, especially in the bearing structure according to the illustrated example, the rotor shaft 2 is urged at any time radially in its direction into the V-slot formed by the supporting disk pairs 3 and 4 and is secured therein. There is a minor lateral overlapping in which the tangential belt 5 is still pressed against the rotor shaft 2 by the pressure roller 6, while the braking lining 11 is already in contact. However, as soon as the braking force is increased by further depressing the brake lever 17, the pressure roller 6 is lifted off completely.

This chronological sequence of the two functions is also maintained if the parts are prone to wear and tear, i.e., the supporting disks 3 and 4 as well as the brake lining 11, have somewhat worn down after a longer operating period.

The additional guide roller 18 ensures that, with the rotor shaft 2 being braked (see FIG. 2), the tangential belt 5 is lifted off entirely from the rotor shaft 2, since the guide roller 18 is somewhat offset with respect to the rotor shaft 2. Furthermore, it can be seen that, during the braking of a spinning rotor 1, the tangential belt 5 is relieved in the zone of the respective spinning station.

Figure 3:
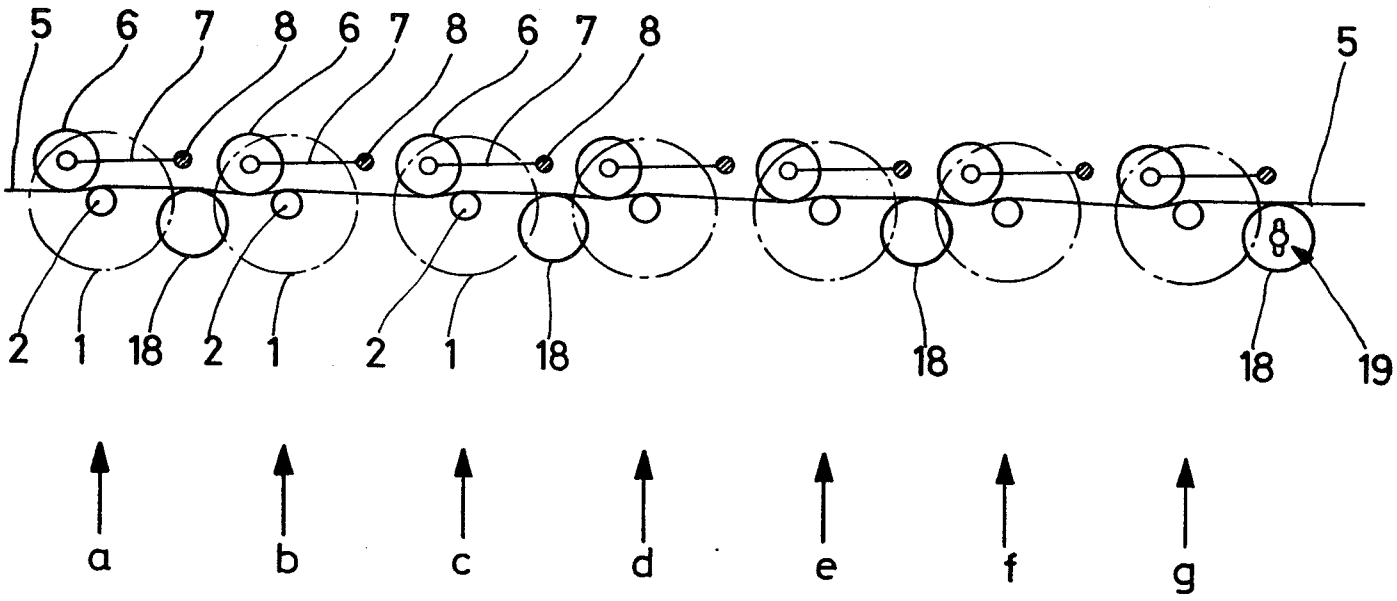
FIG. 3 is a schematic view of a plurality of spinning units, arranged side-by-side, with a tangential belt drive mechanism according to this invention.

FIG. 3 illustrates a plurality of spinning units disposed in side-by-side relation and denoted by *a, b, c, d, e, f,* and *g* in a schematic view. The drawing shows the spinning rotors 1 arranged side-by-side in a row, the rotor shafts 2 of which are driven by a tangential belt 5 extending in the longitudinal direction of the machine. In the region of each individual spinning rotor 1, a pressure roller 6 is mounted for the tangential belt 5; this pressure roller can be lifted off the tangential belt 5 during the braking of the respective spinning rotor 1 by pivoting the swivel arm 7 about the swivel axle 8. As can furthermore be seen from FIG. 3, additional guide rollers 18 are arranged at every second spinning station, i.e., in the illustrated embodiment at the spinning units *a, c, e,* and *g.* These guide rollers are disposed to be somewhat offet with respect to the individual rotor shaft 2, in the manner described above.

Upon the arresting of a spinning rotor 1, whose associated pressure roller 6 has been lifted off, the tangential belt 5 will be relieved in this zone, due to the offset position of the guide roller 18, to such an extent that the respective rotor shaft 2 is completely free of the tangential belt 5. FIG. 3 clearly shows that it is unnecessary in this embodiment to provide a guide roller 18 at each individual spinning unit. However, it may be advantageous in special cases to arrange the guide roller 18 not only at every second spinning unit, but rather at each single spinning unit. The guide rollers 18 are arranged so that a tangent placed from the guide roller periphery guiding the tangential belt to the component following the adjacent rotor shaft 2, which is the second next (next but one) rotor shaft 2 in the illustrated embodiment, extends past the neighboring rotor shaft 2. Since the tangential belt 5 relieved from the pressure roller 6 of one of the spinning units follows this tangent, the tangential belt is completely disengaged from the turbine shaft 2 pertaining to the pressure roller 6.

In FIG. 3, the possibility is indicated schematically at the last guide roller 18 as seen in the traveling direction of the tangential belt 5 that an adjusting possibility 19 can be provided, by means of which the stationary position of the guide roller 18 can be adjusted. This adjusting process, which of course can be effected at each guide roller, serves merely for determining the relative position of the guide rollers 18 and of the rotor shafts 2 with respect to each other before the spinning machine is started.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Apparatus for driving spinning rotors at a plurality of spinning units of an open-end spinning machine; said apparatus including:

a tangential belt extending adjacent spinning rotor shafts of a plurality of said spinning units, pressure means for each of said rotor shafts, said pressure means being arranged at a first side of said tangential belt and being movable between a driving position forcing said tangential belt and associated rotor shaft into driving engagement with one another and a non-driving position with said tangential belt and associated rotor shaft out of driving engagement with one another, and guide members disposed on a second side of said tangential belt opposite said first side, said guide members including belt guide surfaces which are offset with respect to outer belt driven surfaces of said rotor shafts such that a line between guide surfaces of adjacent guide members extends past intervening rotor shafts, said guide members being disposed so that at most two rotor shafts are positioned between respective adjacent guide members, whereby when the pressure means is in a non-driving position, said tangential belt is maintained out of driving contact with said respective rotor shaft by said guide members, wherein said rotor shafts includes a plurality of at least three of said rotor shafts disposed side by side with their rotational axes parallel to one another and in a common plane, and wherein said tangential belt extends parallel to said common plane when in a non-driving position with respect to said rotor shaft.

2. Apparatus according to claim 1, wherein said pressure means are respective pressure rollers.

3. Apparatus according to claim 1, wherein said guide members are guide rollers.

4. Apparatus according to claim 3, wherein said pressure means are respective pressure rollers.

5. Apparatus according to claim 4, wherein a guide roller is arranged between the rotor shafts of each two adjacent spinning units.

6. Apparatus according to claim 4, wherein a guide roller is arranged respectively after the rotor shafts of each set of two successive spinning units.

7. Apparatus according to claim 5, wherein the guide rollers are arranged at the same distance from respectively two adjacent rotor shafts.

8. Apparatus according to claim 6, wherein the guide rollers are arranged at the same distance from respectively two adjacent rotor shafts.

9. Apparatus according to claim 4, wherein the guide rollers are attached to a fixed component so that they are adjustable in the perpendicular direction with respect to the tangential belt.

10. Apparatus according to claim 7, wherein the guide rollers are attached to a fixed component so that they are adjustable in the perpendicular direction with respect to the tangential belt.

11. Apparatus according to claim 8, wherein the guide rollers are attached to a fixed component so that they are adjustable in the perpendicular direction with respect to the tangential belt.

12. Apparatus according to claim 1, further comprising a brake for each spinning unit, wherein the rotor shafts are conventionally supported in V-slots formed by supporting disk pairs, the shafts being pressed into these slots in the operating condition by the tangential belt engaging the shafts and in the braking condition by one of said brakes.

13. Apparatus according to claim 4, further comprising a brake for each spinning unit, wherein the rotor shafts are conventionally supported in V-slots formed by supporting disk pairs, the shafts being pressed into these slots in the operating condition by the tangential belt engaging the shafts and in the braking condition by one of said brakes.

14. Apparatus according to claim 5, further comprising a brake for each spinning unit, wherein the rotor shafts are conventionally supported in V-slot formed by supporting disk pairs, the shafts being pressed into these slots in the operating condition by the tangential belt engaging the shafts and in the braking condition by one of said brakes.

15. Apparatus according to claim 6, further comprising a brake for each spinning unit, wherein the rotor shafts are conventionally supported in V-slots formed by supporting disk pairs, the shafts being pressed into these slots in the operating condition by the tangential belt engaging the shafts and in the braking condition by one of said brakes.

16. Apparatus according to claim 13, wherein the pressure roller pertaining to each spinning unit and a brake are arranged on a common lever system which controls the sequence of the contacting of the pressure roller against the tangential belt and of the brake against the rotor shaft.

17. Apparatus according to claim 14, wherein the pressure roller pertaining to each spinning unit and a brake are arranged on a common lever system which controls the sequence of the contacting of the pressure roller against the tangential belt and of the brake against the rotor shaft.

18. Apparatus according to claim 15, wherein the pressure roller pertaining to each spinning unit and a brake are arranged on a common lever system which controls the sequence of the contacting of the pressure roller against the tangential belt and of the brake against the rotor shaft.

19. Apparatus according to claim 1, wherein said spinning rotors are arranged side-by-side in a row.

* * * * *

UNITED STATES PATENT AND TRADEMARK OFFICE

CERTIFICATE OF CORRECTION

PATENT NO. : 4,103,479

DATED : August 1, 1978

INVENTOR(S) : Fritz Stahlecker and Hans Stahlecker

It is certified that error appears in the above-identified patent and that said Letters Patent are hereby corrected as shown below:

[76] Inventors: Line 3 "Uberkwgen" should read -- Überkingen --

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*